United States Patent [19]

Ray

[11] Patent Number: 4,700,720

[45] Date of Patent: Oct. 20, 1987

[54] KNIVES IN CUTTING MACHINES

[75] Inventor: Eric T. Ray, Andover, England

[73] Assignee: AMF Incorporated, Minneapolis, Minn.

[21] Appl. No.: 754,599

[22] PCT Filed: Apr. 1, 1985

[86] PCT No.: PCT/GB85/00134

§ 371 Date: Jul. 15, 1985

§ 102(e) Date: Jul. 15, 1985

[87] PCT Pub. No.: WO85/04616

PCT Pub. Date: Oct. 24, 1985

[30] Foreign Application Priority Data

Apr. 9, 1984 [GB] United Kingdom ..... 8409157

[51] Int. Cl.[4] ..... A24B 3/07

[52] U.S. Cl. ..... 131/118; 131/117

[58] Field of Search ..... 131/116, 117, 118

[56] References Cited

FOREIGN PATENT DOCUMENTS 0132536 12/1901 Fed. Rep. of Germany .

1195163 6/1970 United Kingdom .

*Primary Examiner*—V. Millin

*Attorney, Agent, or Firm*—Willian Brinks Olds Hofer Gilson & Lione

[57] ABSTRACT

A knife is provided for a tobacco cutting machine and comprises a plate having one surface bevelled to produce a cutting edge and a plurality of grooves formed at right angles to the cutting edge in the surface of the knife which is not bevelled thereby providing a crenellated cutting edge having alternate leading and trailing cutting edges. The groove sare spaced apart in such manner that the width of each leading cutting edge is small enough so that during cutting the induced strain on the cut strand in the region of each leading cutting edge is greater than 0.4.

6 Claims, 9 Drawing Figures

FIG. 1
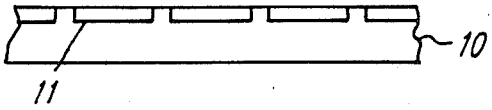
FIG. 2
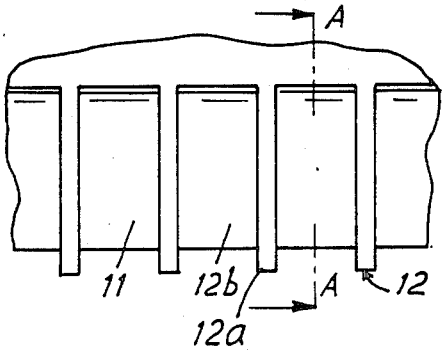
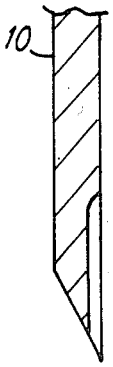
FIG. 3
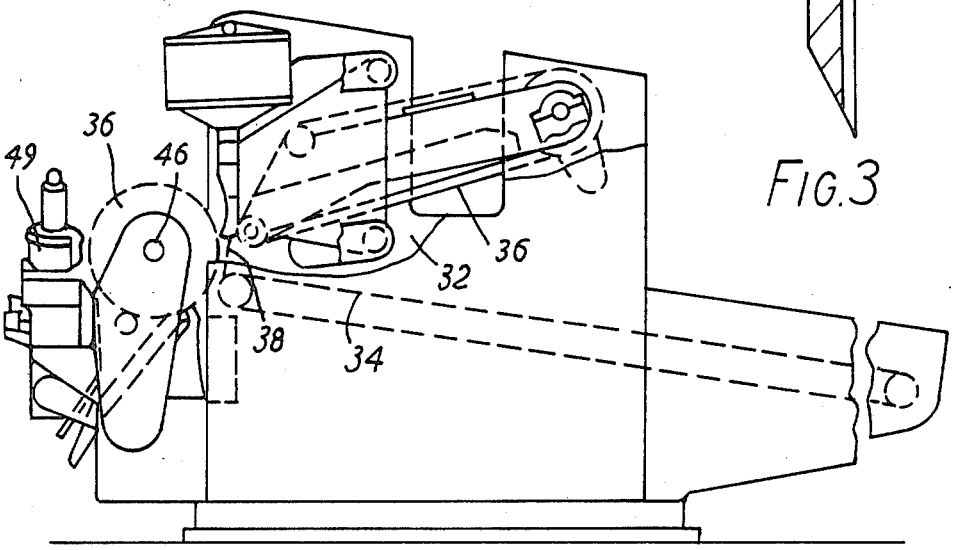
FIG. 4
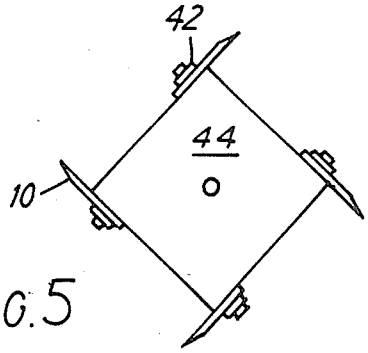
FIG. 5

KNIVES IN CUTTING MACHINES

This invention relates to a knife for a cutting machine particularly but not solely for cutting tobacco.

The machine used for cutting the tobacco is of the well known type in which the leaf is fed into a convergent throat of rectangular cross section formed by two parallel plates and two converging conveyor bands or by two parallel plates and two converging roller conveyors. At the convergent end of the throat is a mouthpiece. The leaf is fed into the throat at the divergent end and is driven by the conveyor bands or rollers towards the mouthpiece, where the leaf is cut as it issues from the mouthpiece either by a single knife caused to reciprocate across the mouthpiece by one or more knives arranged in a holder which rotates on an axis either at right-angles or parallel to the axis of the throat, so that the cutting edge of the knife or knives are caused to pass across the mouthpiece. The convergence of the throat compresses the leaf sufficiently so that it may be cut and not pulled from the mouthpiece. One of the two band or roller conveyors is free to move and pressure is applied to it so that the compression of the leaf can be regulated. The width of cut of the shreds can be adjusted by altering the conveyor speed and hence the distance the compressed leaf is fed through the mouthpiece between cuts by the knife or knives.

STATEMENT OF PRIOR ART

A cross-cutting knife for such a machine is disclosed in U.S. Pat. No. 1,195,163 and comprises a plate having one surface bevelled to produce a cutting edge and a plurality of grooves formed at right angles to the cutting edge in the surface of the knife which is not bevelled thereby providing a crenellated cutting edge.

By this design the knife can simultaneously produce a first cut and a cross-breakage with a single passage of the knife through the leaf. With this knife, the leaf only passes once through a cutting machine thus avoiding a second compression and produces a very much more uniform cut.

The knife described in British Pat. No. 1,195,163 works very well when the grooves are $\frac{1}{8}''$–$\frac{3}{8}''$ (3.2–9.6 mm) wide at $\frac{1}{4}''$–$\frac{3}{4}''$ (6.35–18.9 mm) pitch. However, the length of pieces required in cigarette tobacco filler or similar products can be as large as 1.5" (38.1 mm).

Rectangular section grooves at right angles to the cutting edge at a pitch 1.5 to 2 times the groove width have been used in an attempt to cut controlled length pieces in the range 5/16"–1.5" (8–38.1 mm) with the result that piece lengths greater than that required were often present in the product, more noticeably so as the control length increased.

When the rectangular blade as described in UK Patent No. 1,195,163 passes through the tobacco portions of the lamina at the leading cutting edge are displaced away from the main body of tobacco (or cheese). Consequently the displaced pieces of lamina elongates by an amount equal to twice the displacement. If F is the displacement and the width of the leading cutting edge is G then the displaced pieces are each elongated to a length equal to $G+2F$ or else they break. The induced strain, which is the elongation divided by the original length, is therefore $2F \div G$. However, the cut piece may break, most predictably at a sharp corner of the leading cutting edge with the consequence that a strand can be as much as three times larger than required i.e., breaks could occur at the two sharp corners of two adjacent leading cutting edges, which corners are remote from each other; the strand therefore comprising the two pieces of lamina displaced by the adjacent leading edges and the piece between them displaced by the trailing cutting edge.

OBJECT OF THE INVENTION

An object of the invention is to provide a blade that will predictably break the strands at desired positions along the blade edge whereby definitive lengths of strand can be achieved irrespective of pitch.

SUMMARY OF THE INVENTION

According to the invention there is provided a knife for a cutting machine comprising a plate having two major surfaces, one major surface being bevelled to form a cutting edge and a plurality of grooves formed at right angles to the cutting edge in the other major surface of the knife which is not bevelled thereby providing ribbed portions and a crenellation of said cutting edge such that the latter has alternate identical narrow leading cutting edge portions 0.5–2 mm wide (G) and relatively wide identical trailing cutting edge portions 6.35–38.1 mm wide, said grooves having a depth (F) such that the strain (S) induced by each leading cutting edge portion or the cut strand in the region of each leading cutting edge portion is from 1.6 to 6.4 as derived from the equation $S=2F/G$.

By using narrow leading cutting edges the strand breakage is almost independent of groove width.

BRIEF DESCRIPTION OF DRAWINGS

Constructional forms of the invention will now be described by way of example with reference to the accompanying drawings in which:

FIG. 1 shows in end elevation part of a knife having grooves of rectangular cross-section;

FIG. 2 shows the knife in plan;

FIG. 3 is a section on A—A of FIG. 2;

FIG. 4 is a side elevation of a rotary cutting machine;

FIG. 5 is an axial elevation of the drum carrying the knives;

DESCRIPTION OF PREFERRED EMBODIMENTS

Figure 6:
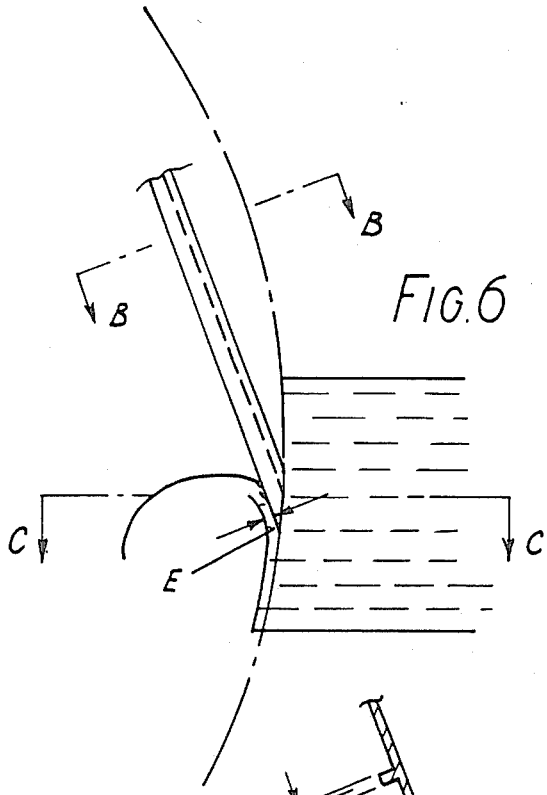
FIG. 6 is a schematic cross-section of the tobacco cheese in the rotary cutting machine.
Figure 7:
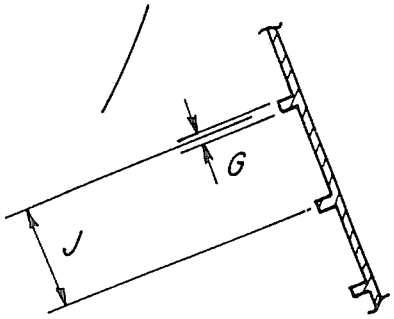
FIG. 7 is a section taken along the line B—B in FIG. 6.

The knife 10 as shown in FIGS. 1 to 3 has an overall thickness of about 3 mm and is bevelled at one side in the manner of a conventional knife. Rectangular section grooves 11 are cut at right angles to the cutting edge, in the face of the knife which is not bevelled, and pitched such that ribs 0.4" (0.1–10 mm), more especially 0.02"–0.08" (0.5–2 mm) wide are formed. The effect of the grooves is to produce a crenellated cutting edge 12 with alternate narrow, leading cutting edges **12*a* and relatively wide trailing cutting edges 12*b*** on two common lines spaced apart. The knife is sharpened by grinding the bevel in the same way as a conventional knife; the two lines of cutting edges being sharpened simultaneously. The grooves are typically ¼" to 1.5" (6.35–38.1 mm) wide, 1/16" (1.6 mm) deep and sharp cornered. A particular knife suitable for cutting the leaf has grooves 1.5" (38.1 mm) in width and spaced apart by 1.562" (39.67 mm) and a groove depth of 1/16" (1.6 mm). The bevel is ground 18 degrees to the grooved face of the knife. The grooves are therefore so close together that the leading cutting edges are relatively narrow, 0.062" (1.57 mm) i.e., the blade is substantially ribbed.

The flank side height (F) is preferably 1 to 3 times the width (G) of cut of the leading cutting edge. The knife may be used in a reciprocating single knife cutting machine of the kind described in U.S. Pat. No. 1,195,163 or in a rotary cutter as shown in FIGS. 4 and 5.

In the rotary machine as shown in FIGS. 4 and 5, tobacco is fed onto the space 32 between two converging conveyor belts 34 and 36 which carry the tobacco to a mouthpiece 38 and at the same time compress it so that it is driven through the mouthpiece as a plug. As the plug emerges it is shredded by knife 10 carried in holders 42 on a drum 44 which rotates about an axis 46 in bearings carried by arms 47. The cutter edges of the knives all lie on an imaginary cylindrical surface. The knives are arranged in this example with the grooves away from the mouthpiece.

With the knives in the fixed condition a continuous grinding can be effected by a grinding wheel 49 which has a drive mechanism for traversing it along the knives as they rotate. The bevelled surface will be part cylindrical in this case. Alternatively the knives may be brought in turn to a fixed grinding position and ground one at a time by a grinding wheel of which the normal to the grinding face at the point of contact with the knife does not pass through the drum axis. Here the bevelled surface is flat and raked in relation to its cylindrical path. The bevelled surface may be part cylindrical.

Figure 8:
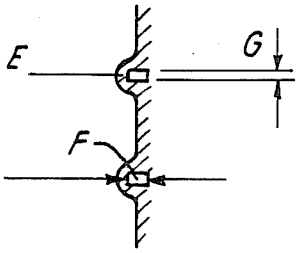
FIG. 8 is a section taken along the line C—C in FIG. 6.

As shown in FIGS. 6 and 8 the leading cutting edges each cut and displace a piece of compressed laminae having a thickness E which is displaced by an amount F equal to the thickness of the section of the leading edge taken substantially at right-angles to the direction of travel of the blade at the level of the trailing cutting edges. The width G of the leading cutting edge is so small in relation to the displacement F that the strain $2F \div G$ is from 1.6 to 6.4. Accordingly, the strands of tobacco break at each leading cutting edge so that a controlled length J is achieved.

Figure 9:
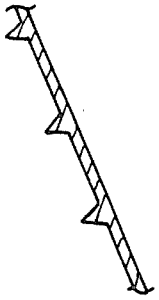
FIG. 9 is a section similar to that taken along the line B—B in FIG. 6 except that the ribs are substantially triangular in section.

The ribs of the blade may be trapesoidal or, as shown in FIG. 9, triangular in section for increased strength and for greater accuracy of the controlled length H since the strands break at the centres of the leading edges. The triangular configuration may be so dimensioned with an upper angle of 90°.

Another form of the invention may comprise leading cutting edges which in section are each substantially rectangular modified with a pitched distal portion. The ribs may be of cuspidate section i.e., substantially triangular with concave sides.

I claim:

1. A knife for a cutting machine comprising a plate having one major surface bevelled to form a cutting edge and a plurality of grooves formed at right angles to the cutting edge in the other major surface of the knife which is not bevelled thereby providing ribbed portions and a crenellation of said cutting edge such that the latter has alternate identical narrow leading cutting edge portions 0.5–2 mm wide (G) and relatively wide identical trailing cutting edge portions 6.35–38.1 mm wide, said groove having a depth (F) such that the strain (S) induced by each leading cutting edge portion on the cut strand in the region of each leading cutting edge portion is from 1.6 to 6.4 as derived from the equation $S=2F$.

2. A knife according to claim 1, wherein the depth of the grooves is about 1.6 mm.

3. A knife according to claim 1, wherein the ribbed portions between the grooves are rectangular in cross-section.

4. A knife according to claim 1, wherein the ribbed portions are of cuspidate section.

5. A knife according to claim 1, wherein the grooves are rectangular in cross-section.

6. A cutting machine comprisng a conveyor for driving the material to be cut to a cutting position, means for effecting compression of said material at said cutting position, a plurality of knives mounted on a rotatory drum and a drive means for effecting rotation of said drum, each knife comprising a plate having two major surfaces, one major surface being bevelled to form a cutting edge and a plurality of grooves formed at right angles to the cutting edge in the other major surface of the knife which is not bevelled thereby providing ribbed portions and a crenellation of said cutting edge having alternate identical narrow leading cutting edge portions 0.5–2 mm wide (G) and relatively wide identical trailing cutting edge portions 6.35–38.1 mm wide, said grooves having a depth (F) such that the strain (S) induced by each leading cutting edge portions on the cut strand in the region of each leading cutting edge portions is from 1.6 to 6.4 as derived from the equation $S=2F$.

* * * * *